United States Patent [19]

Kusano

[11] Patent Number: 4,605,935

[45] Date of Patent: Aug. 12, 1986

[54] SHAPED BEAM REFLECTOR ANTENNA

[75] Inventor: Mitsuhiro Kusano, Tokyo, Japan

[73] Assignee: NEC Corporation, Tokyo, Japan

[21] Appl. No.: 664,712

[22] Filed: Oct. 25, 1984

[30] Foreign Application Priority Data

Oct. 28, 1983 [JP] Japan ..... 58-202372

[51] Int. Cl.[4] ..... H01Q 15/16

[52] U.S. Cl. ..... 343/914

[58] Field of Search ..... 343/840, 912–916

[56] References Cited

U.S. PATENT DOCUMENTS 3,995,275 11/1976 Betsudan et al. ..... 343/914

FOREIGN PATENT DOCUMENTS 84505 5/1983 Japan .

*Primary Examiner*—Eli Lieberman

*Attorney, Agent, or Firm*—Sughrue, Mion, Zinn, Macpeak & Seas

[57] ABSTRACT

A shaped beam antenna of the type comprising a main reflector and a feed horn for irradiating an electromagnetic wave upon said main reflector, the main reflector including, in sectional planes inclusive of a Y-Z plane and planes parallel thereto, a central section and horizontal side end sections adjoining the central section, where Cartesian coordinates are assumed having an origin near the feed horn, a Z-axis extending in a direction of the horizontal center axis of the feed horn, and X- and Y-axes extending in planes perpendicular to the Z-axis. The central section has a plurality of torus reflector segments and each of the side end sections has a plurality of parabolic reflector segments, and the torus and parabolic reflector segments are grouped into first and second portions, the first portion having the reflector segments which are symmetrical with respect to the Y-Z plane, the second portion having first and second sub-portions, the reflector segments of the first sub-portion and those of the second sub-portion being asymmetrical with respect to the Y-Z plane, whereby the maximum radiation direction of the beam reflected from the first portion lies in the Y-Z plane, and the maximum radiation direction of the beam reflected from the second portion lies in planes other than the Y-Z plane.

2 Claims, 12 Drawing Figures

SHAPED BEAM REFLECTOR ANTENNA

BACKGROUND OF THE INVENTION

This invention relates to a reflector type antenna utilized in radio communication, and more particularly a shaped beam antenna in which a radiation beam extends in a sector shape in a plane but in another shape in a plane perpendicular thereto.

In an ordinary microwave radio communication, the antenna with a pencil beam utilized to exchange communications between two radio stations aligned on a long-distance straight line is required to have a high gain and low sidelobe characteristic. However, to effect communication between a plurality of slave stations scattered in a zone and a single master station, the antenna utilized in the master station is desired to have a so-called shaped beam for efficiently irradiating the zone in which slave stations are scattered.

Although various types of shaped beam antennae have been proposed, they involve many problems to be solved, as will be described later in detail.

SUMMARY OF THE INVENTION

Accordingly, the present invention intends to eliminate the prior art drawbacks and has for it object to provide a shaped beam antenna capable of improving the cross polarization discrimination of a sector beam in the horizontal plane and efficiently forming radiation beams in the vertical planes at both side ends of the sector shaped beam.

According to the present invention, in a shaped beam antenna of the type comprising a main reflector and a feed horn for irradiating an electromagnetic wave upon the main reflector, the main reflector including, in sectional planes inclusive of a Y - Z plane and planes parallel thereto, a central section and horizontal side end sections adjoining said central section, where Cartesian coordinates are assumed having an origin near the feed horn, a Z-axis extending in a direction of the horizontal center axis of the feed horn, and X- and Y-axes extending in planes perpendicular to the Z-axis, the central section has a plurality of torus reflector segments and each of the side end sections has a plurality of parabolic reflector segments, and the torus and parabolic reflector segments are grouped into first and second portions, the first portion having the reflector segments which are symmetrical with respect to the Y - Z plane, the second portion having first and second sub-portions, the reflector segments of the first sub-portion and those of the second sub-portion being asymmetrical with respect to the Y - Z plane, whereby the maximum radiation direction of the beam reflected from the first portion lies in the Y - Z plane, and the maximum radiation direction of the beam reflected from the second portion lies in planes other than the Y - Z plane.

DESCRIPTION OF THE PREFERRED EMBODIMENTS

Figure 1:
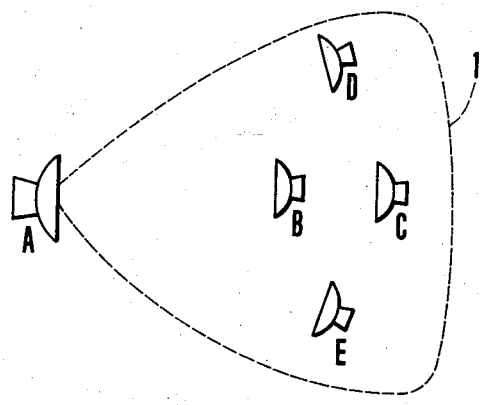
FIG. 1 is a plan view showing an arrangement of a master station and a plurality of slave stations in a radio communication system.
Figure 2:
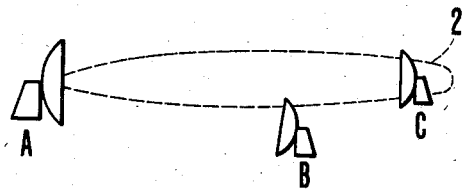
FIGS. 2 and 3 are side views showing the arrangement of the master station and the slave stations.
Figure 3:
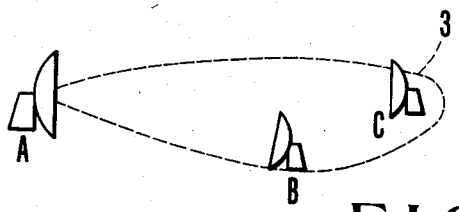
Figure 4:
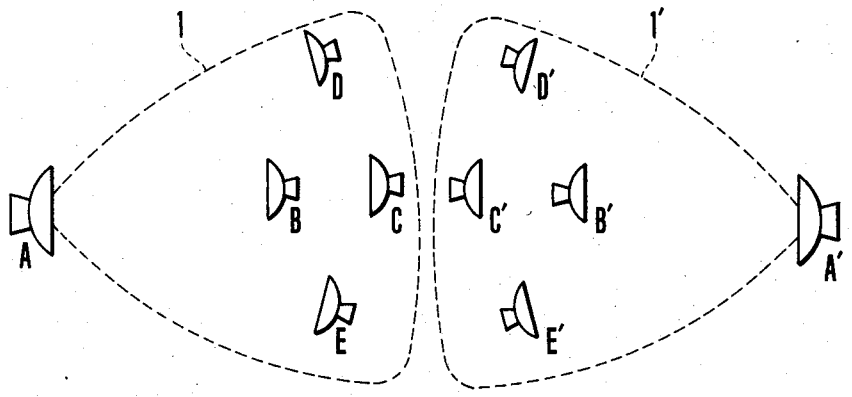
FIG. 4 is a plan view showing a state in which two of communication zone as shown in FIG. 1 are located in closely adjacent relationship.

With reference to FIGS. 1, 2 and 3, the efffect of beam shaping will first be described in which A designates a master station and B, C, D and E designate slave stations. In the arrangement shown in FIG. 1, it is desirable that a beam 1 radiated from the antenna of the master station extends in the horizontal plane in the shape of a sector as shown by dotted lines to cover all slave stations.

On the other hand, in the vertical plane, when the difference in altitude between the slave stations and the difference in distance from the master station between the slave stations are taken into consideration, the shape of a radiation beam 3 shown in FIG. 3 is more advantageous than an ordinary pencil shaped radiation beam 2 shown in FIG. 2. Where two communication zones of the master and slave stations are closely adjacent, orthogonally polarized waves are used so as to prevent interference between radiated beams 1 and 1'. In such a case, the quality of cross polarizaton discrimination between two polarized radiation beams 1 and 1' governs the quality of the communication line. The interference occurs in a horizontal plane interconnecting stations A and C shown in FIG. 3 but the radiated beam in a plane interconnecting stations A and B is shielded by the ground so that the interference between adjacent radiation beams does not results in any appreciable problems.

Figure 5:
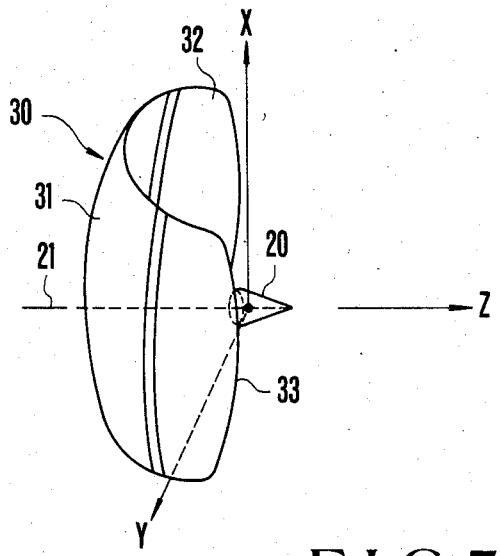
FIG.5 PRIOR ART
FIG. 5 is a perspective view showing a prior art shaped beam antenna.
Figure 6:
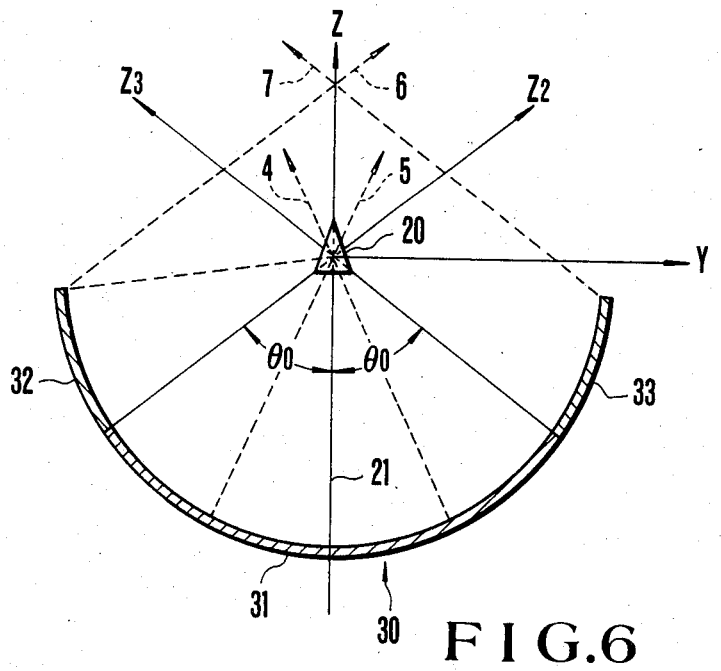
FIG.6 PRIOR ART
FIG. 6 is a horizontal sectional view of the prior art shaped beam antenna.
Figure 7:
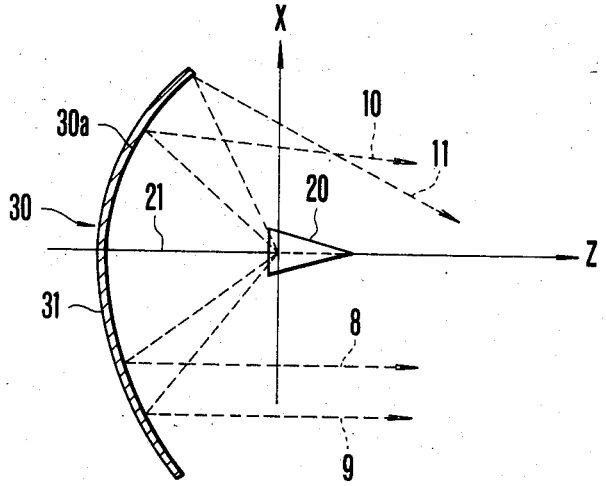
FIG.7 PRIOR ART
FIG. 7 is a vertical sectional view of the prior art shaped beam antenna.
Figure 8:
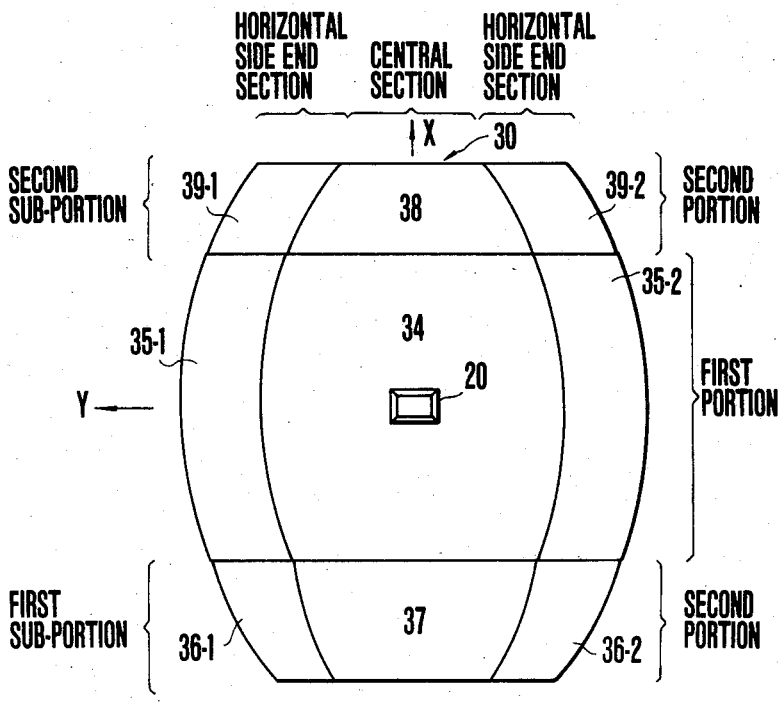
FIG. 8 is a front view showing a first embodiment of the shaped beam antenna according to this invention.

For synthesizing the shaped beams, a shaped beam antenna has been proposed as disclosed in, for example, Japanese Patent Application No. 183369/1981 (Japanese Laid Open Patent specification No. 84505/1983). As shown in FIGS. 5, 6 and 7, this antenna comprises a main reflector 30 in the form of a composite reflector, and a feed horn 20. The main reflector 30 includes a torus reflector section 31, and parabolic reflector sections 32 and 33. The torus reflector section 31 has an arcuate reflection surface obtained by rotating a sectioned curve 30*a* as shown in FIG. 7 about an X-axis of Cartesian coordinates X, Y, Z having an origion at the feed horn 20 by an angle $\theta_o$(see FIG. 6), and each of the parabolic reflector sections 32 and 33 has a part of a parabolic surface obtained by rotating a parabola about its center axis $Z_2$ or $Z_3$.

Consequently, the spherical wave front radiated from the feed horn 20 with its beam center 21 disposed to coincide with a minus Z-axis direction is reflected by the torus reflector section 31 in a horizontal plane (Y - Z plane) so as to pass through electromagnetic wave paths 4 and 5 shown by dotted lines, thus forming a concentric radiation wave front about the origin, while electromagnetic waves reflected by parabolic reflector sections 32 and 33 are converted into plane waves which pass through electromagnetic wave paths 6 and 7 shown by dotted lines so as to propagate in the directions of the parabolic rotation center axes $Z_2$ and $Z_3$. Accordingly, the radiation characteristic in the horizontal plane is substantially uniform in an angular range of $\pm\theta_o$ with respect to the Z-axis as a result of synthesis of respective wave fronts, thus obtaining a so-called sector shaped beam.

On the other hand, in the vertical plane, as shown in FIG. 7, the spherical wave radiated from the feed horn 20 is converted into a wave front, a portion thereof passing through electromagnetic wave paths 8 and 9 shown by dotted lines in the Z-axis directiin while another portion passing through electromagnetic wave paths 10 and 11 shown by dotted lines in a direction which is inclined with respect to the Z-axis, whereby, as a whole, it is possible to synthesize an asymmetric beam such as radiation beam shown in FIG. 3.

However, with the prior art shaped beam antenna, the reflector section that forms a wave front travelling horizontally or in the Z-axis direction is asymmetrical with respect to the horizontal plane (Y - Z plane), as shown in FIG. 7, so that there is a defect that cross polarization components generated by this section degrades the cross polarization discrimination in the horizontal plane.

Moreover, it has been difficult to shape, in the vertical plane at either side ends of the sector shaped beam, the beam into a shape similar to the radiated beam 3 shown in FIG. 3 becasue both the side or horizontal end sections of the main reflector 30 take the form of an ordinary parabolic reflector, and because the level of irradiation from the feed horn 20 is lower at these parabolic reflector sections than at the central section.

A first embodiment of the shaped beam antenna shown in FIGS. 8 to 11 comprises a feed horn 20 and a main reflector 30 having a central section including torus reflector segments 34, 37 and 38 and horizontal side sections including parabolic reflector segments 35-1, 36-1 and 39-1; 35-2, 36-2 and 39-2. These reflector segments, are grouped into first and second portions of the main reflector 30. The first portion of the main reflector 30 includes a set of reflector segments 34, 35-1 and 35-2 which are symmetrical with respect to the Y - Z plane and the X - Z plane, while the second portion including a lower first sub-portion of reflector segments 37, 36-1 and 36-2 and an upper second sub-portion of reflector segments 38, 39-1 and 39-2, the first and second sub-portions being asymmetric with respect to the Y - Z plane.

The radiation characteristic in the horizontal plane of the shaped beam antenna of the first embodiment will be described with reference to FIG. 9. More particularly, the torus reflector segment 34 of the first portion is formed by rotating the sectioned curve in the X - Z plane shown in FIG. 10 about the X-axis by an angle $\theta_o$, while the parabolic segments 35-1 and 35-2 have their center axes Z 35-1 and Z 35-2 as the centers of rotation. The radiation characteristics of the beam shaped antenna shown in FIG. 8 has a sector extension in the horizontal plane in the same manner as described above in connection with FIG. 6.

Figure 9:
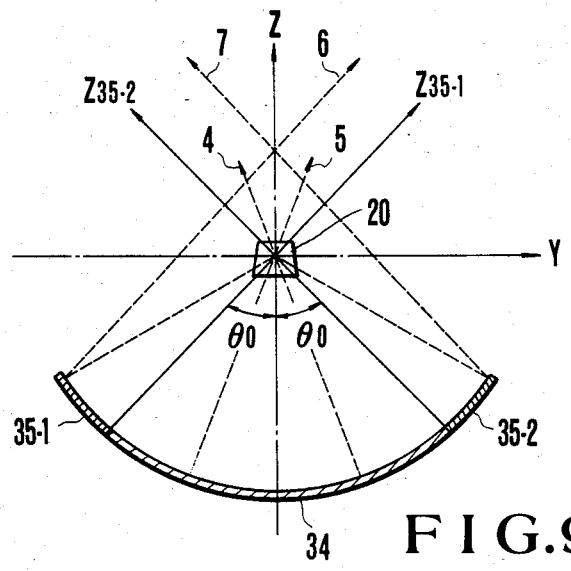
FIG. 9 is a sectional view of the first embodiment of the invention taken along Y - Z directions.
Figure 10:
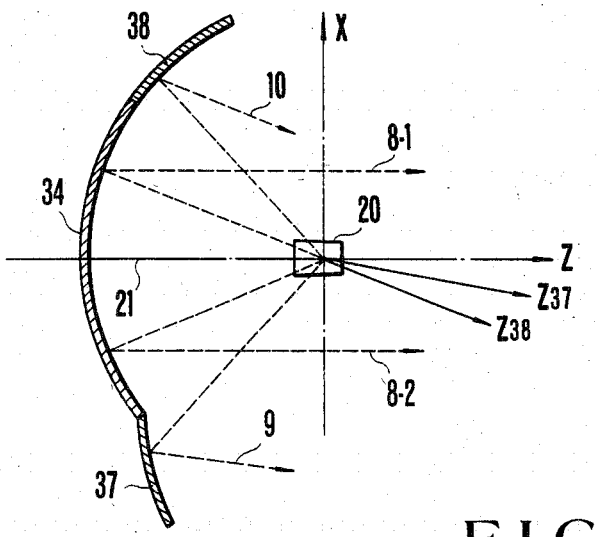
FIG. 10 is a sectional view of the first embodiment taken along X - Z directions.

Although FIG. 9 is a sectional view in the Y - Z plane taken in the first portion of the main reflector 30, the curves sectioned in planes parallel to the Y - Z plane taken in the second portion, that is, in the first sub-portion of the torus segment 37 and parabolic segments 36-1 and 36-2 and in the second sub-portion of the torus segment 38, and parabolic segments 39-1 and 39-2 have the same configuration as in the case shown in FIG. 9. However, as shown in FIG. 10, since the axes of respective first and second sub-portions do not lie in the horizontal plane, the maximum radiation direction of the radiation characteristic of the second portion appears in a plane other than the horizontal plane. Accordingly, it is possible to synthesize a beam having a sector shape in the Y - Z plane and each plane parallel thereto.

In FIG. 10, the sectioned curve of the torus segment 34 of the first portion is of a parabola having a center axis at the Z-axis and symmetrical with respect thereto, while the sectioned curves of the torus segments 37 and 38 of the second portion have parts of parabolas having center axes at the axes $Z_{37}$ and $Z_{38}$ of respective parabolas. Accordingly, a portion of the spherical wave radiated by the feed horn 20 and reflected by the torus segment 34 is radiated as a wave front propagating in the Z-axis, that is, in the horizontal direction through electromagnetic wave paths 8-1 and 8-2.

The electromagnetic waves reflected by the torus segments 37 and 38 are radiated as wave fronts propagating in the directions of center axes $Z_{37}$ and $Z_{38}$ of respective parabolas through electromagnetic wave paths 9 and 10. The radiation characteristic in the X - Z plane is determined by synthesizing respective wave fronts. More particularly, as will be seen from a radiation beam characteristic 12 shown at solid line in FIG. 11, a synthesized or resultant beam becomes asymmetrical with reference to the Z axis. Dotted line radiation beam characteristics 13 and 14 respectively correspond to the main polarization characteristic and the cross polarization discrimination characteristic of the electromagnetic wave radiated from the segment 34 of the first portion, while a dotted line radiation beam characteristic 15 represents the main polarization component of the electromagnetic waves radiated by the second segments 37 and 38 of the second portion. The cross polarization discrimination characteristic such as the dotted line beam characteristic 14 is excellent because the torus reflector segment 34 is symmetrical with respect to the Z-axis and hence, the cross polarization wave components generated by this reflector segment cancel with each other on the Z-axis.

The cross polarization wave components produced by torus reflector segments 37 and 38 which are asymmetrical with respect to the Z-axis do not have any adverse effect upon the Z-axis because the maximum radiation directions of respective main polarization components deviate from the Z-axis. As a consequence, the overall cross polarization discrimination becomes excellent as indicated by a solid line radiation beam characteristic 16.

As can be noted from the description regarding FIG. 9, the characteristic in the X - Z plane is substantially the same within an angular range of $\pm\theta_o$ so that in the Y - Z plane, an excellent cross polarization discrimination can be obtained. Although the characteristic in the X - Z plane has been described with reference to FIG. 10, the characteristics at both horizontal side ends are substantially the same as the characteristic in the X - Z plane with the result that both the horizontal side end sections contribute to the formation of beams in the vertical plane at both the horizontal side ends of a sector shaped beam, thereby improving the quality of the beam formed at the horizontal side ends.

Figure 12:
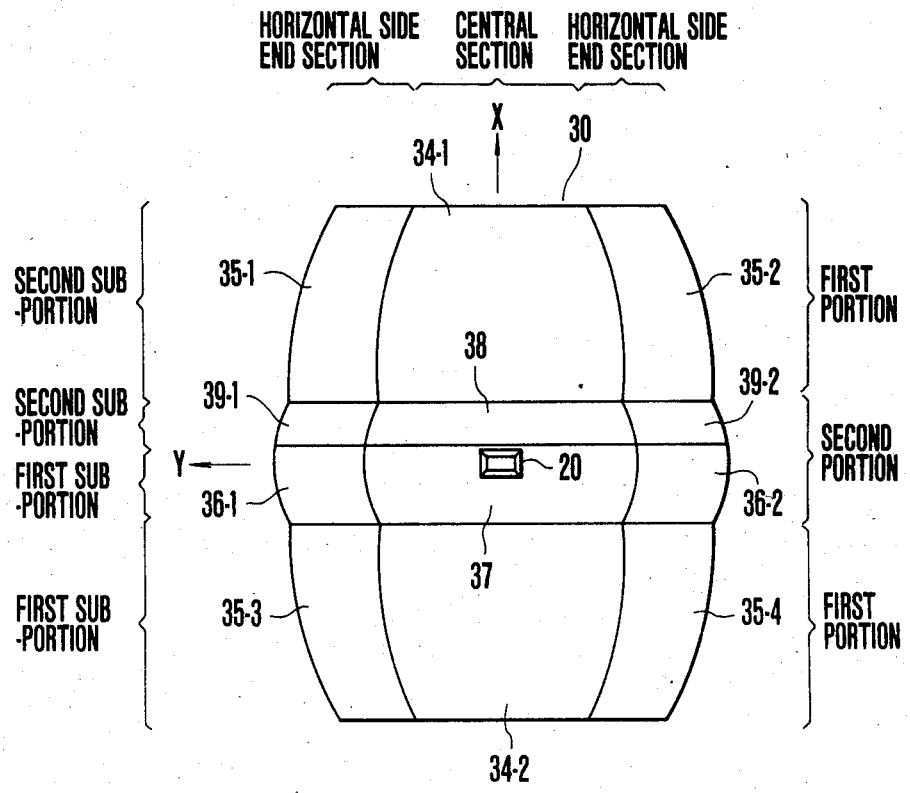
FIG. 12 is a front view showing a second embodiment of the shaped beam antenna according to this invention.

FIG. 12 shows a second embodiment of the shaped beam antenna according to this invention. A main reflector shown in FIG. 12 comprises a central section including torus reflectdor segments 34-1, 34-2, 37 and 38 and horizontal side end sections including parabolic reflector segments 35-1, 35-3, 36-1 and 39-1; 35-2, 35-4, 36-2 and 39-2. A first portion of the main reflector 30 includes a lower first sub-portion having reflector segments 34-2, 35-3 and 35-4 and an upper second sub-portion having segments 34-1, 35-1 and 35-2. The first and second sub-portions of the first portion are symmetrical with respect to the Y - Z plane and X - Z plane. A second portion of the main reflector 30 includes a first sub-portion having segments 36-1, 36-2 and 37 and a second sub-portion having segments 38, 39-1 and 39-2. The first and second sub-portions of the second portion are asymmetrical with respect to the Y - Z plane.

Figure 11:
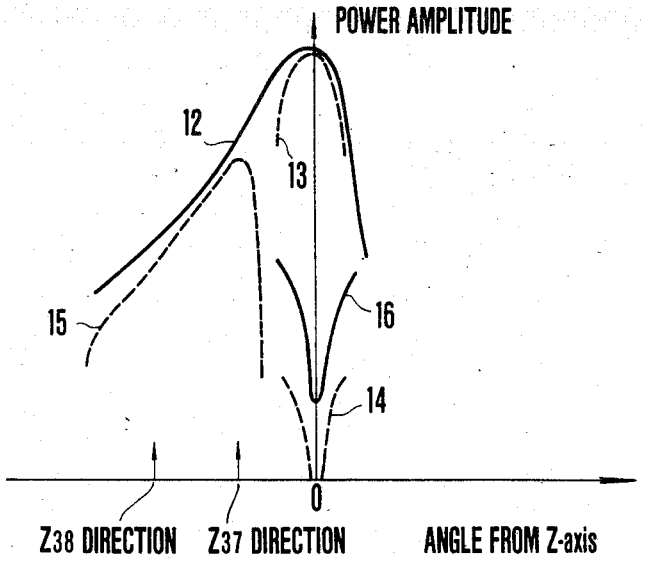
FIG. 11 shows the radiation characteristics of the first embodiment of the invention.

In the second embodiment, the arrangement of the first and second portions is opposite to or vertically reversed to that of the first embodiment and is made to meet various configurations of the shaped beam in the vertical plane shown in FIG. 11. In other words, this arrangement is made for the purpose of making wider the shaped beam by changing positions of the wave sources of respective reflector segments. Other operations of the second embodiment are the same as those of the first embodiment.

For the purpose of description, although in the foregoing description, the sectioned curves in the X - Z plane of the torus refelctor segments 37 and 38 contributing to the shaping of a beam in the vertical plane are respectively depicted as parabolas, it should be understood that this is not essential to this invention. Curves, for example, those shown in FIG. 14 of Japanese Laid Open Patent Specification No. 84505/1983, which are shaped to contribute to the shaping of a beam in the vertical plane may be used.

Two or more parabolas may be combined. Furthermore, although in the foregoing description all antennae are transmitting antennae, they may be receiving antennae because of the reciprocity of the antenna.

As described above, according to this invention it is possible to efficiently irradiate the electromagnetic wave upon the zones, and to improve the cross polarization discrimination in the horizontal plane. Especially, when the invention is applied to an antenna of a master station of a system in which radio communications are made between the master station and a number of slave stations scattered in a zone, a large advantageous effect can be attained.

What is claimed is:

1. In a shaped beam antenna of the type comprising a main reflector and a feed horn for irradiating an electromagnetic wave upon said main reflector, said main reflector including, in sectional planes inclusive of a Y - Z plane and planes parallel thereto, a central section and horizontal side end sections adjoining said central section, where Cartesian coordinates are assumed having an origin near said feed horn, a Z-axis extending in a direction of the horizontal center axis of said feed horn, and X- and Y-axes extending in planes perpendicular to said Z-axis, the improvement wherein said central section has a plurality of torus reflector segments and each of said side end sections has a plurality of parabolic reflector segments, and said torus and parabolic reflector segments are grouped into first and second portions, said first portion having the reflector segments which are symmetrical with respect to the Y - Z plane, said second portion having first and second sub-portions, the reflector segments of said first sub-portion and those of said second sub-portion being asymmetrical with respect to the Y - Z plane, whereby the maximum radiation direction of the beam reflected from said first portion lies in said Y - Z plane, and the maximum radiation direction of the beam reflected from said second portion lies in planes other than said Y - Z plane.

2. The shaped beam antenna according to claim 1 wherein arrangement of said first and second portions is vertically reversed.

* * * * *